US005511249A

United States Patent [19]

Higgins

[11] Patent Number: 5,511,249

[45] Date of Patent: Apr. 30, 1996

[54] CAP WITH CROWN OPENING

[75] Inventor: Laura Higgins, Indianapolis, Ind.

[73] Assignee: Jerry Piotrowicz, Castlewood, Ind.; a part interest

[21] Appl. No.: 306,410

[22] Filed: Sep. 15, 1994

[51] Int. Cl.[6] ..... A42B 1/04

[52] U.S. Cl. ..... 2/209.7; 2/195.1

[58] Field of Search ..... 2/195.1, 209.3, 2/209.7, 7, 171, 171.4, 171.5, 171.6, 171.7, 171.8, 174, 175.1, 195.7

[56] References Cited

U.S. PATENT DOCUMENTS

| | | | |
|---|---|---|---|
| 1,598,379 | 8/1926 | Kerr | 2/209.7 |
| 1,624,727 | 4/1927 | Goldberg | 2/195.1 |
| 2,753,566 | 7/1956 | Perelman | 2/171.5 |
| 4,991,237 | 2/1991 | Dwyer | 2/209.7 |
| 5,321,854 | 6/1994 | Kronenberger | 2/209.7 |
| 5,325,540 | 7/1994 | Kronenberger | 2/195.1 |

*Primary Examiner*—Diana Biefeld
*Attorney, Agent, or Firm*—Robert A. Spray

[57] ABSTRACT

A head cap having an opening on its upper central or crown portion of the cap body, the opening being for receiving a "ponytail" hair style, with the walls around the opening providing lateral support to the ponytail. A neat and trim appearance of the ponytail extending through the opening is achieved, and the attractive vertical support is given to the ponytail even though given only by lateral support. In another embodiment, at least two openings are provided, spaced laterally of the median line of the cap body, accommodating a dual ponytail style.

2 Claims, 2 Drawing Sheets

CAP WITH CROWN OPENING

I. FIELD AND BACKGROUND OF THE INVENTION

The present invention relates to a headdress for the wearing on a person's head.

More particularly, the invention relates to a cap form of headdress of a special nature, i.e., a cap which provides and achieves the dual advantages of both the provision of a crown hole in the cap body through which may be pulled a bundle of hair in a so-called "ponytail" style, and which utilizes he special location of the cap crown to provide a type of vertical support for the ponytail body.

The invention also provides a plurality of ponytail openings, providing special and attractive effects for the wearer.

II. SUMMARY OF THE INVENTION

In carrying out the invention in a preferred form, there is provided a head cap, generally of a type often called a "baseball cap" or a "sports cap," with an opening on its upper central portion, i.e., crown portion of the cap body; and the opening is of a size of about one inch or larger, sufficient to accommodate a bundle of hair strands in a so-called "pony tail" style tightly held together, the bundle of hair strands being provided to have a supporting nature by the lateral support given by the body material around the opening.

This provides the advantage of not only a neat and trim appearance of the bundled hair extending through the opening, but the crown-location of the opening provides that an attractive vertical support is given to the hair bundle even though the cap body walls around the opening have no significant vertical thickness or extent, and give the hair bundle only a lateral nature of support. Also, the hair bundle itself gives support to the cap, holding it in place.

In another embodiment, an alternate attractiveness is provided, with not one but at least two openings being provided, and with the openings spaced laterally of the median line of the cap body, thus accommodating an attractive dual ponytail effect.

III. PRIOR ART, AS FAILING TO SHOW NOVEL CONCEPTS OF THE PRESENT INVENTION

The prior art has known and used a great variety of caps and hats having supportive body portions which could have been adapted to incorporate the novel concepts of this invention.

Such variety in nature, and widespread universal knowledge and use of caps and hats, is of course here conceded.

However, the advantageous nature of the present invention is especially illustrated by contrasting it with the references found in a prior art Search in the U.S. Patent Office after this invention was made and during consideration of the patenting efforts. The Search showed the following, all U.S. patents:

U.S. Pat. No. 2,859,448

U.S. Pat. No. 4,872,218

U.S. Pat. No. 5,170,509 and

U.S. Pat. No. 5,321,854

The one of these which is probably the least remote is that of Kronenberger (U.S. Pat. No. 5,321,854) which was issued as recently as Jun. 21, 1994. The patents cited during its examination were:

U.S. Pat. No. 1,614,231

U.S. Pat. No. 1,624,727

U.S. Pat. No. 1,704,576

U.S. Pat. No. 1,996,254

U.S. Pat. No. 2,864,383

U.S. Pat. No. 3,041,628

U.S. Pat. No. 4,991,237

U.S. Pat. No. 4,998,544 and

U.S. Pat. No. 5,170,509

Considering all these, i.e., both sets of citations, individually and accumulatively, helps rather than detracts from the conclusion here of the inventiveness of the present concepts for none, even though covering a span of several decades, shows its features in their combinations and in the setting of the prior art cap bodies as is here emphasized.

IV. PRIOR ART CAPABILITY AND MOTIVATIONS, AS HELPING TO SHOW PATENTABILITY HERE

Even in hindsight consideration of the present invention to determine its inventive and novel nature, it is not only conceded but emphasized that the prior art had many details usable in this invention, but only if the prior art had had the guidance of the present concepts of the present invention, details of both capability and motivation.

That is, it is emphasized that the prior art had/or knew several particulars which individually and accumulatively show the non-obviousness of this combination invention. E.g., a. The prior art has long had caps of many styles and varieties;

b. The prior art has long had caps with holes in the cap body for the provision of ventilation and cooling;

c. An uncountable number of persons have worn their hair in pony tail style arrangements, probably females for many decades but also males for many years; and surely many if not most of those persons have worn various types of headdress including various types of hats and caps;

d. The prior art has even known and provided caps having a hole in a portion of the cap body through which a ponytail bundle of hair may be drawn (Kronenberger, as cited above), avoiding an earlier need for the ponytail bundle to emerge from under the bottom edge of the cap or from a recess which extends upwardly from the bottom edge of the cap;

e. The market potential for caps of this novelty does not exclude persons unlikely to use sports caps, because the novelty of this invention provides for such persons a possibility of an attractive ponytail hair style independently of the desire of that wearer to use a sport type cap;

f. The vast majority of wearers of ponytail hair style, probably at least female wearers of ponytail hair style, seem to like variations in their hair style from time to time, also increasing the likelihood that a vertically supportive cap body feature could have been conceived, but only if such wearers had had the novel concepts of the present invention;

g. The advantage and the "feel" to the wearer of a firmly-supported body of the wearer's ponytail hair style, especially to a wearer who is a sports person, is to be seen as not only an advantage to the wearer but also as to another reason for the expected enlargement of the purchasers of a sports cap having these novel features;

h. The prior art has long had the knowledge and equipment to provide holes in the type of cloth or plastic sheeting from which sport caps are made;

i. The field of headdress for both male and female consumers is very extensive and competitive, and surely many of the millions of cap wearers and ponytail wearers are reasonably expected to own a plurality of caps and hats, all making the commercial incentive for inventors and manufacturers of caps and hats to be practically unlimited as incentive to have created caps with the novel features of the present invention;

j. Such known needs have surely given manufacturers ample incentive to have made modifications for commercial competitiveness in a competitive industry;

k. All of the manufacturing procedures involved in the production of articles of this invention are within the sufficient skill of the prior art, more than ample skill to have achieved the present invention, but only if the concepts and their combination had been conceived;

l. Substantially all of the operational characteristics and advantages of details of the present invention, when considered separately from one another and when considered separately from the present invention's details and non-technical accomplishment of the details, are within the skill of persons of various arts, but only when considered away from the integrated and novel combination of concepts which by their cooperative combination achieves this advantageous invention;

m. The details of the present invention, when considered solely from the standpoint of construction, are exceedingly simpler and the matter of simplicity of construction has long been recognized as indicative of inventive creativity; and n. Similarly and a long-recognized indication of inventiveness of a novel combination, is the realistic principle that a person of ordinary skill in the art, as illustrated with respect to the claimed combination as differing in the stated respects from the prior art both as to construction and concept, is that the person of ordinary skill in the art is presumed to be one who thinks along the line of conventional wisdom in the art and is not one who undertakes to innovate.

Accordingly, although the prior art has had capability and motivation, amply sufficient to presumably give incentive to the development of special effect caps according to the present invention, the fact remains that the present invention has awaited the present creativity and inventive discovery of the present inventors. In spite of ample motivation and capability shown by the many illustrations herein, the prior art did not suggest this invention.

V. SUMMARY OF THE PRIOR ART'S LACK OF SUGGESTIONS OF THE CONCEPTS OF THE INVENTION'S COMBINATION

In spite of all such factors of the prior art, the problem here solved awaited these inventors' present invention's creativity. More particularly as to the novelty here of the invention as considered as a whole, the resume, of the prior art knowledge and needs, helps show its contrast to the present concepts, and emphasizes the advantages, novelty, and the inventive significance of the present concepts as are here shown, particularly as to the multi-purpose utility.

Moreover, prior art articles known to this inventor which could possibly be adapted for this duty, fail to show or suggest the details of the present concepts as a combination and a realistic consideration of the prior art's differences from the present concepts of the overall combination may more aptly be described as teaching away from the presence invention's concepts, in contrast to suggesting them, even as to a hindsight attempt to perceive suggestions from a backward look into the prior art, especially since the prior art has long had much motivation as to details of the present invention and to its provisions.

And the existence of such prior arc knowledge and related articles embodying such various features is not only conceded, it is emphasized; for as to the novelty here of the combination, of the invention as considered as a whole, a contrast to the prior are helps also to remind both the great variety of the various prior art articles and needed attempts of improvement, and the advantages and the inventive significance of the present concepts. Thus, as shown herein as a contrast to all the prior art, the inventive significance of the present concepts as a combination is emphasized, and the nature of the concepts and their results can perhaps be easier understood.

Although varieties of prior art are conceded, and ample motivation is shown, and full capability in the prior art is conceded, no prior art shows or suggests details of the overall combination of the present invention, as is the proper and accepted way of considering the inventiveness nature of the concepts.

That is, although the prior art may show an approach to the overall invention, it is determinatively significant that none of the prior art shows the novel and advantageous concepts in combination, which provide the merits of this invention, even though certain details are shown separately from this accomplishment as a combination.

And the prior art's lack of an invention of a special-effect cap or hat achieving the convenience, multi-purpose utility, simplicity of construction, and other advantages of the present invention, which are goals only approached by the prior art, must be recognized as being a long-felt need.

Accordingly, the various concepts and components are conceded and emphasized to have been widely known in the prior art as to various devices; nevertheless, the prior art not having had the particular combination of concepts and details as here presented and shown in novel combination different from the prior art and its suggestions, even only a fair amount of realistic humility, to avoid consideration of this invention improperly by hindsight, requires the concepts and achievements here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art.

VI. BRIEF DESCRIPTION OF THE DRAWINGS

The above description of the novel and advantageous invention is of somewhat introductory and generalized form. More particular details, concepts, and features are set forth in the following and more detailed description of the illustrative embodiment, taken in conjunction with the accompanying drawings, which are of somewhat schematic and diagrammatic nature, for showing the inventive concepts; and in the drawings.

VII. DETAILED DESCRIPTION OF ILLUSTRATIVE EMBODIMENTS

Figure 2:
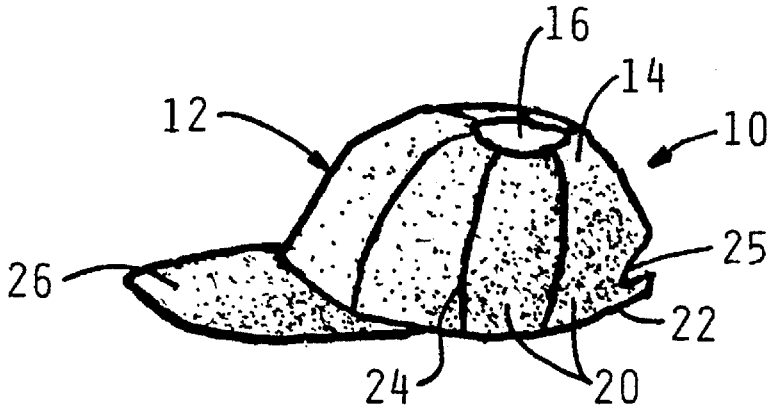
FIG. 2 is a left side elevation view of the novel cap shown in FIG. 1.
Figure 1:
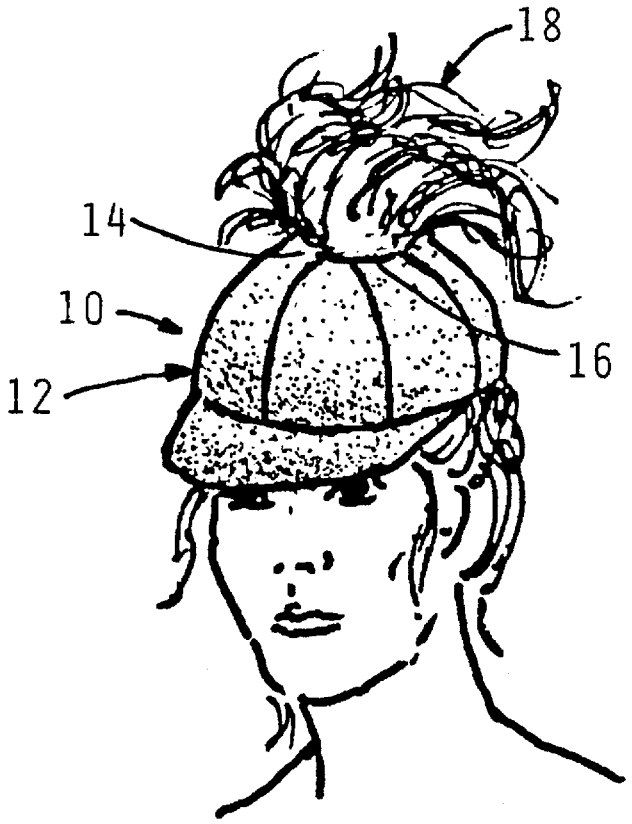
FIG. 1 is an illustration of a lady wearing a novel cap according to Embodiment No. 1 of the present invention.

The inventive concepts are shown in the Drawings with embodiments of caps, often called "sport caps."

Such caps are quite conventional in many respects, and of course are a common headdress for being worn over the hair on the head of a human being wearer.

This type of cap 10 generally consists of a cap body 12 formed into a hemi-spherical shape. Conventionally, the cap body 12 has a crown portion 14 which consists of an area at and closely adjacent the top, i.e., apex of the cap body 12, and which, when the cap body is placed over the head of the wearer, is generally juxtaposed over the crown of the wearer's head; and in that conventional condition of wearing the cap 10, the crown portion of the cap body 12 is then in a general registry with the crown of the wearer's head.

The inventive concepts take advantage of the prior art cap construction, and in fact build upon factors of prior art caps; and it may be first noted, in that respect, that the cap body 12 provides support for the crown portion 14 of the cap 10. Into the supported crown area 14 of the cap body 12, there is provided an opening 16 in the crown portion 14 of the cap body 12, the cap body 12 providing its support not merely for the upmost top but for the portions of the crown portion 14 adjacent the opening 16.

The opening 16 in the crown location, it is to be especially noted, is so located that those crown portions 14 adjacent the opening 16 will provide lateral support for the hair of the wearer when the hair 18 is extended through the opening 16, laterally supporting the hair such as to establish a supported vertical orientation of the hair.

Moreover, with the opening 16 located in or slightly frontal of the front portion of crown area 14, the wearer's hair 18 serves to maintain the cap body 12 firmly in place as the wearer is moving into the wind or is engaging in riding, jogging, or other sports activities.

Accordingly, the location of the hair opening 16 serves the dual purpose of the cap body 12 supporting the hair bundle 18, and the hair bundle 18 supporting the fit of the cap body 12 on the wearer's head.

Thus, the cap body 12 with the hair opening 16 located in the crown area, or slightly frontal thereof, has the plural advantage not only of novelty, but gives the incentive of attractive ponytail hair styles, even to those persons who would not have otherwise used a ponytail hair style, as well as providing an attractive means of assuring that the wearer's hair will remain out of the way during sports or wind conditions.

Further building on prior art, the prior art nature of paneling, as a basic nature of the cap body 12, is advantageously used with the present concepts. Preferably in this regard, the cap body 12 is provided by a circumferential series of panels or gores 20, each panel 20 having a bottom edge 22 and side edges 24, the panels 20 being operatively interconnected along their bottom edges 22, and each panel 20 connected to an adjacent panel 20 along its side edges and operatively interconnected in the region of the crown portion 14 of the cap body 12. The cap has a conventional size-adjustable fastener 25 at the rear of the cap, but that performs no part of the present invention.

The gores 20 are connected along their side edges, and are each generally of triangular shape, except as the top portions are cut away by the opening 16, the opening 16 intersecting the top portion of the gores 20 at a location such that the cutaway portion of each of the gores contributes to the opening 16 specified above for the passing therethrough of a multiple-strand ponytail arranged bundle of hair 18.

The present concepts are particularly advantageously used in a cap 10 in which there is provided a frontal bill body 26 which extends forwardly from the lower edge of the front ones of panels 20. With such a bill-type cap 10, especially if the bill is of a large size, the above-mentioned advantage of the wearer's hair extending through the hair opening 16, is of special advantage.

Figure 4:
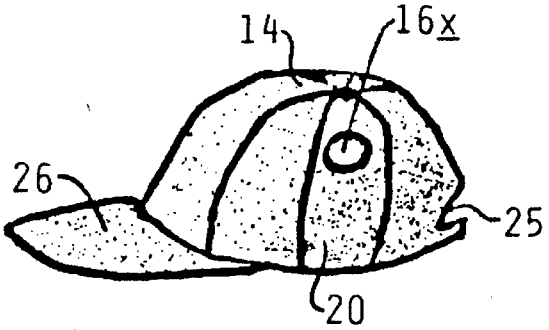
FIGS. 4 and 5, respectively, are a left and a right side elevation view of a cap of Embodiment No. 2.
Figure 5:
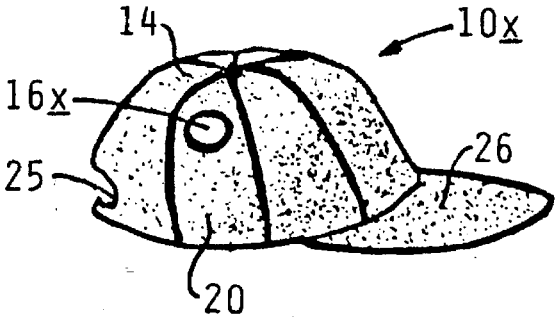
Figure 3:
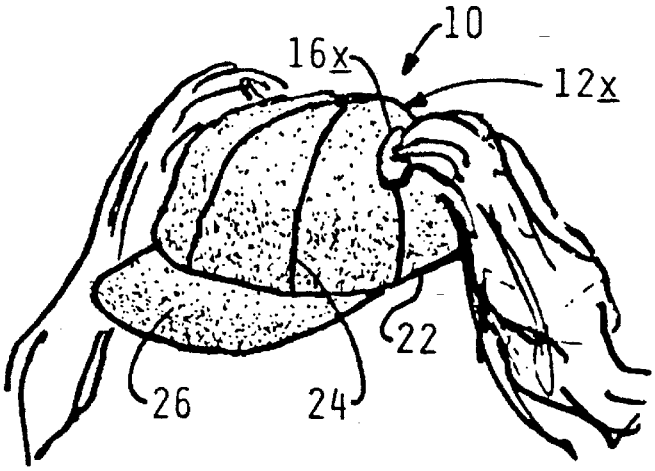
FIG. 3 is a pictorial illustration of a cap of Embodiment No. 2 of the present invention, the view also schematically showing a bundle of hair as emerging from each of the two laterally-spaced hair openings of this Embodiment No. 2.

Another hair style is accommodated by the concepts illustrated in FIGS. 3–5, where the cap 10*x* with its cap body 12*x* is shown provided with at least two openings 16*x*, each being of at least one inch in effective diameter, and provided in the cap body 12*x* oppositely spaced with respect to the front-to-back median of the cap body. This permits an attractive dual-ponytail hair style.

VIII. SUMMARY AND CONCLUSION

As a novel special-effect cap or hat, it is thus seen that an article constructed and used according to the combination of inventive concepts and details herein set forth, provides novel and useful concepts of a desirable and usefully advantageous article, yielding advantages which are and provide special and particular advantages when used as herein set forth, especially for use to accommodate attractive ponytail hair styling.

In summary as to the nature of the overall article's advantageous concepts, their novelty and inventive nature is shown by novel features of concept and construction shown here in advantageous combination and by the novel concepts hereof not only being different from all the prior art known, and even though forms of hats and caps, including those with holes in the cap body have been known and used for many years, but because the achievement is not what is or has been suggested to those of ordinary skill in the art, especially realistically considering this as a novel combination comprising components which individually are similar in effect to what is well known to most all persons who are engaged in the field of cap and/or hat manufacture and most all persons who wear that type of headdress.

The prior art has tolerated disadvantages of wearing caps without features of the present invention, but only by various means of pulling a ponytail out from under the cap or more recently by pulling a ponytail outwardly through a hole in the rear of the cap body.

Yet no prior art components or elements have even suggested the modifications of any other prior art to achieve the particulars of the novel concepts of the overall combination here achieved, with the special advantages which the overall combination article provides; and this lack of suggestion by any prior art has been in spite of the long world-wide use of various hats or caps, and in spite of the knowledge of natural principles as used in the cap bodies of the present invention.

The differences of concept and construction as specified herein yield advantages over the prior art; and the lack of this invention by the prior art, as a prior art combination, has been in spite of this invention's apparent simplicity of the construction once the concepts have been conceived, in spite of the advantages it would have given, and in spite of the availability of knowledge of the principles, and availability of the equipment for achieving the novel concepts in new or existing hats or caps.

Quite certainly the particular combination of prior art details as here presented in this overall combination has not been suggested by the prior art, this achievement in its particular details and utility being a substantial and advantageous departure from prior art, even though millions have long known and used caps and hats, and also used ponytail hair styles. And particularly is the overall difference from the prior art significant when the non-obviousness is viewed by a consideration of the subject matter of this overall article as a whole, as a combination integrally incorporating features different in their combination from the prior art, in contrast to merely separate details themselves, and further in view of the prior art's general knowledge, and use of concepts and articles not achieving particular advantages here achieved by this combination of details.

Accordingly, it will thus be seen from the foregoing description of the invention according to these illustrative embodiments, considered with the accompanying Drawings, that the present invention provides new and useful concepts of a novel and advantageous article, possessing and yielding desired advantages and characteristics in formation and use, and accomplishing the intended objects, including those hereinbefore pointed out and others which are inherent in the invention as being an advantageous and novel combination.

Modifications and variations may be effected without departing from the scope of the novel concepts of the invention accordingly, the invention is not limited to the specific embodiment or form or arrangement of parts herein described or shown. Unless the context shows otherwise, words are to be interpreted in their usual or broad sense, e.g., the word "cap" as meaning any sort of headdress whether usually called a "cap," a "hat," or "floppy" or other headgear which can give support in the crown area.

I claim:

1. A cap for being worn over the hair on the head of a human being wearer, the cap having a cap body member formed into a generally hemi-spherical shape, the cap also having a crown portion at the apex of the body member; and the crown portion, when the cap body member is placed over the head of a wearer, is generally juxtaposed over the crown of the wearer's head, such that the crown portion of the cap body member is then in a general registry with the crown of the wearer's head, the cap body member providing support for the crown portion of the cap, the cap being provided with an opening having a continuous and generally circular perimeter in the crown portion of the cap, or slightly frontal thereof, the cap body member providing support for the portions of the crown portion adjacent the opening, and the opening being so located that those crown portions adjacent said opening will provide lateral support for the hair of a wearer when the hair is extended through the opening, laterally supporting the hair such as to establish a vertical orientation of the hair, the opening being about one inch in diameter, sufficient to accommodate a multiple-strand ponytail arranged bundle of hair in ponytail style tightly held together, the opening having its rearmost portion extending into the cap crown portion, and the rearmost portion of the opening having a width which is large enough to accommodate a multiple-strand ponytail arranged bundle of hair passing through the opening;

the cap body member being comprised of at least five gores of material which are connected along their side edges, and wherein each of the gores has a truncated generally triangular shape wherein the apex of each gore is cut off thereby creating an upper edge at the top of each gore, and wherein the upper edges of all the gores collectively form the continuous perimeter of the crown opening.

2. A cap as set forth in claim 1, wherein the gores are arranged in a circumferential series, each gore having a bottom edge and side edges, the gores being operatively inter-connected along their bottom edges, and each gore operatively inter-connected in the region of the crown portion of the cap body.

* * * * *

UNITED STATES PATENT AND TRADEMARK OFFICE

CERTIFICATE OF CORRECTION

PATENT NO. : 5,511,249

DATED : Apr. 30, 1996

INVENTOR(S) : Laura Higgins

It is certified that error appears in the above-identified patent and that said Letters Patent is hereby corrected as shown below:

Col. 2, line 13; there should be a ";"after "concepts"

Col. 3, line 29; spelling of "simple;" should be corrected

Col. 3, line 65; spelling of "present" should be corrected

Col. 4, line 56; spelling of "embodiments" should be corrected.

Col. 7, line 30; After invention there should be added a ";"

Col. 7, line 37; "I claim" should be "IX CLAIMS"
" IX CLAIMS " (first occurance)

Signed and Sealed this

Third Day of September, 1996

*Attest:*

*Attesting Officer*

Bruce Lehman

BRUCE LEHMAN

*Commissioner of Patents and Trademarks*